US006213519B1

(12) United States Patent
Bosch

(10) Patent No.: US 6,213,519 B1
(45) Date of Patent: Apr. 10, 2001

(54) REPOSITIONABLE SECUREMENT STRIP WITH MESSAGE FOR BUSINESS CARDS AND COURTESY CARDS

(76) Inventor: Michael C. Bosch, P.O. Box 12012, Reno, NV (US) 89510

( * ) Notice: Subject to any disclaimer, the term of this patent is extended or adjusted under 35 U.S.C. 154(b) by 150 days.

(21) Appl. No.: 08/839,984

(22) Filed: Apr. 24, 1997

(51) Int. Cl.[7] ..... B42D 15/00

(52) U.S. Cl. ..... 283/81; 40/638; 283/101; 402/79

(58) Field of Search ..... 283/81, 101, 117, 283/56; 281/2, 5, 51, 35, 22, 95, 96, 97; 402/79, 80 R; 40/636, 299, 638, 594; D19/1, 2; D20/27

(56) References Cited

U.S. PATENT DOCUMENTS

| | | | | |
|---|---|---|---|---|
| 4,103,821 | * | 8/1978 | Gartshore et al. | 283/81 |
| 4,191,405 | * | 3/1980 | Johnstun | 462/84 |
| 4,236,731 | * | 12/1980 | Hektoen | 462/6 |
| 4,643,452 | | 2/1987 | Chang . | |
| 4,679,823 | * | 7/1987 | Nagy | 281/15 |
| 4,905,392 | | 3/1990 | Klein | 40/638 |
| 4,968,540 | | 11/1990 | Linsenbigler | 428/5 |
| 4,993,751 | * | 2/1991 | Sawyer | 462/17 |
| 5,169,254 | * | 12/1992 | Arkwright . | |
| 5,199,923 | * | 4/1993 | Muller | 462/18 |
| 5,219,183 | * | 6/1993 | McKillip | 283/81 |
| 5,282,649 | * | 2/1994 | Williams et al. | 283/81 |
| 5,318,825 | | 6/1994 | Naber . | |
| 5,382,055 | | 1/1995 | Mertens et al. . | |
| 5,408,950 | * | 4/1995 | Porto . | |
| 5,622,389 | * | 4/1997 | Courtney | 283/81 |

* cited by examiner

*Primary Examiner*—A. L. Wellington
*Assistant Examiner*—Monica S. Carter
(74) *Attorney, Agent, or Firm*—David A. Lingbeck

(57) ABSTRACT

A repositionable securement strip with message for business and courtesy cards includes a strip of paper having a front side and a back side and further having a first narrow band of repositionable adhesive disposed transversely on the back side for removably attaching the strip of paper to an object. The repositionable securement strip further includes a second narrow band of repositionable adhesive disposed transversely and intermediate on the front side for removably securing the card thereon and also includes a special message being informational or courtesy imprinted near the bottom edge on the front side of the strip of paper. This repositionable securement strip allows the user to neatly arrange and removably secure the card to an object to substantially prevent the loss of the card before the receiver even receives it.

14 Claims, 2 Drawing Sheets

REPOSITIONABLE SECUREMENT STRIP WITH MESSAGE FOR BUSINESS CARDS AND COURTESY CARDS

BACKGROUND OF THE INVENTION

This invention relates to a repositionable securement strip with message for business cards and courtesy cards which can be stuck to an object such as a wall, board, or sheet of paper.

People sending out small courtesy cards or inserting such courtesy cards inside doors do so with the risk of such cards being lost and without the receiver ever receiving the announcement. The receiver who opens the mail may do so without ever knowing that a small announcement card may also be inside the envelope and throw the envelope in the waste without ever receiving the announcement. Further, the receiver who opens one's door at home, for instance, may not be aware of a small announcement card inserted between the door and the door jamb and won't know of the special announcement and will miss out on what the announcement was all about. In addition, in many instances, winning and losing a customer may be determined upon the impersonal information given to the customer and the way that information is presented. Announcement cards, namely business cards, loosely provided in an envelope don't present itself in as much of a positive light or professional manner to the receiver as do business cards which are neatly attached to the front side of the letter in the envelope and is made neatly available to the receiver. None of the prior art discloses features which allows the user to be able to present announcement cards in a neat, organized, professional manner to the receiver.

One known prior art is a BUSINESS CARD ATTACHING STRIP, U.S. Pat. No. 4,643,452, invented by Kwei K. Chang and issued on Feb. 17, 1987, which comprises an elongated strip of material having a plurality of predetermined shaped edge openings and further comprising an adhesive coating along one edge of the strip of material including a strip of adhesive coating material for conveniently attaching a business card thereto.

Another known prior art is a NOTE OR NOTE PAD PREPARATION METHOD, U.S. Pat. No. 5,382,055, invented by Timothy A. Mertens and issued on Jan. 17, 1995, which comprises a first and second sheets and layers of pressure-sensitive adhesive in a predetermined pattern on the rear surface of each of the sheets Another known prior art is a PAPER-PRODUCT SHEET HAVING CONCEALED REPOSITIONABLE ADHESIVE, U.S. Pat. No. 5,318,825, invented by Thomas C. Naber and issued on Jun. 7, 1994, which comprises a paper-product sheet with a border portion folded to the back surface and further comprising concealed repositionable adhesive disposed entirely between the interfacing surfaces defined by the folded border portion.

Another known prior art is an ADHESIVE BACKED BUSINESS CARD FOR MOUNTING ON FILE CARD, U.S. Pat. No. 4,905,392, invented by Gerald B. Klein and issued on Mar. 6, 1990, which comprises the method of mounting and displaying a planar and generally rectangular business card in a file system.

Another known prior art is an ADHESIVE SECUREMENT STRIP FOR BOWS AND GREETING CARDS, U.S. Pat. No. 4,968,540, invented by James G. Linsenbigler and issued on Nov. 6, 1990, which comprises an elongated rectangular strip with the front and back surfaces being coated with adhesive and with the strip being divided into three zones and with a bow secured to the first zone and with an aperture through the third zone for displaying the strip on a rack.

None of the prior art discloses a repositionable securement strip designed to removably attach to an object and to removably secure a card for a neat presentation to the receiver thus substantially preventing possible loss of the card.

SUMMARY OF THE INVENTION

This invention relates to a repositionable securement strip with message for business cards and announcement cards which includes a generally rectangular strip of paper having a front side and a back side with a first narrow band of repositionable adhesive near the top on the back side of the strip and a second narrow band of repositionable adhesive on the front side of the strip and with a special message on the front side of the strip, the message either providing additional information not provided on the card or providing a courtesy to the receiver. The strip of paper is quite useful for neatly organizing or keeping track of a card on an advertisement, stationary or other objects including a wall or door.

One objective of the repositionable securement strip with message for business and courtesy cards is to provide a means for essentially preventing loss of such cards when they are put in envelopes and in between objects such as between the door and door jamb.

Another objective of the repositionable securement strip with message for business and courtesy cards is to provide a means to neatly arrange such cards on objects and to provide additional information not provided on the cards.

Yet, another objective of the repositionable securement strip with message for business and courtesy cards is to give more of a professional appearance when such cards are being used with business stationary or advertisements.

Further objectives and advantages of the present invention will become apparent as the description proceeds and when taken in conjunction with the accompanying drawings wherein:

DETAILED DESCRIPTION OF THE INVENTION

Figure 1:
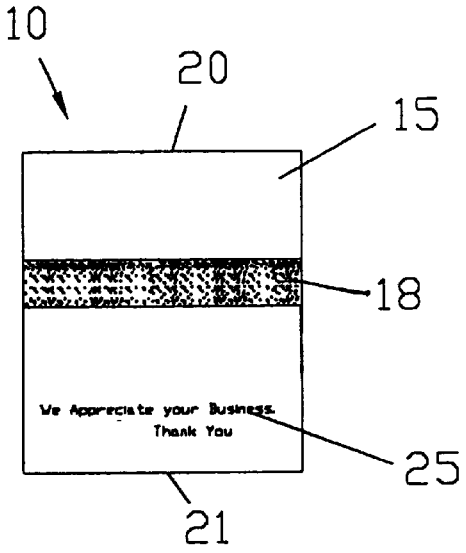
FIG. 1 is a front elevational view of the repositionable securement strip with message.
Figure 2:
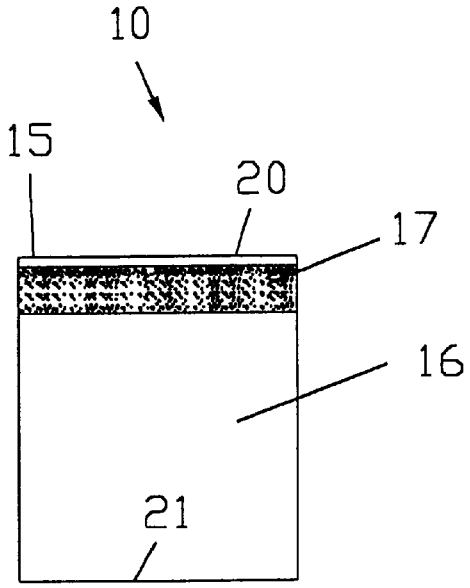
FIG. 2 is rear elevational view of the repositionable securement strip with message.
Figure 3:
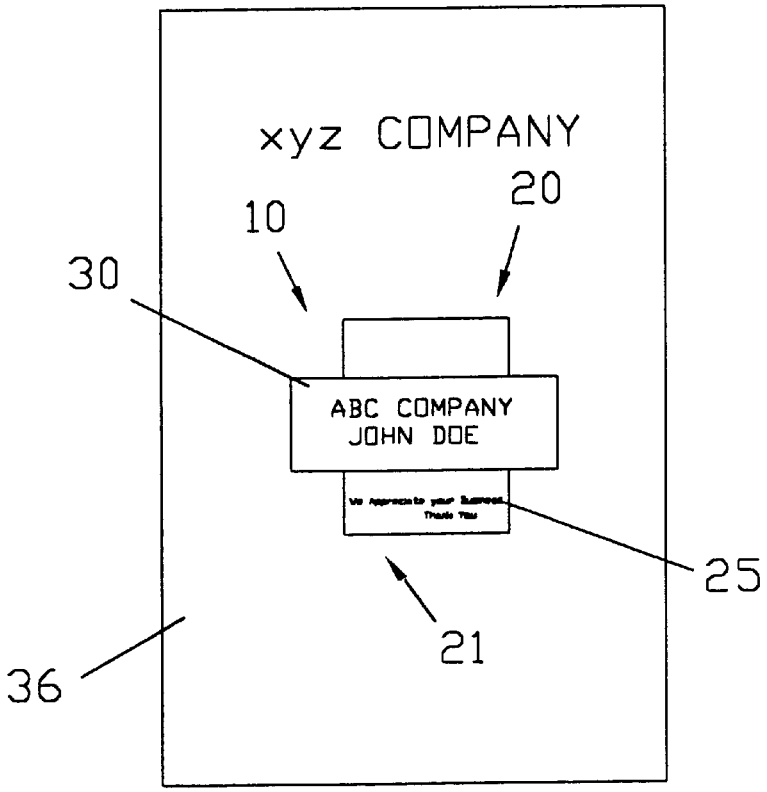
FIG. 3 is a front elevational view of the repositionable securement strip with message and with a business card secured to the strip and with the strip secured to a piece of stationary.
Figure 4:
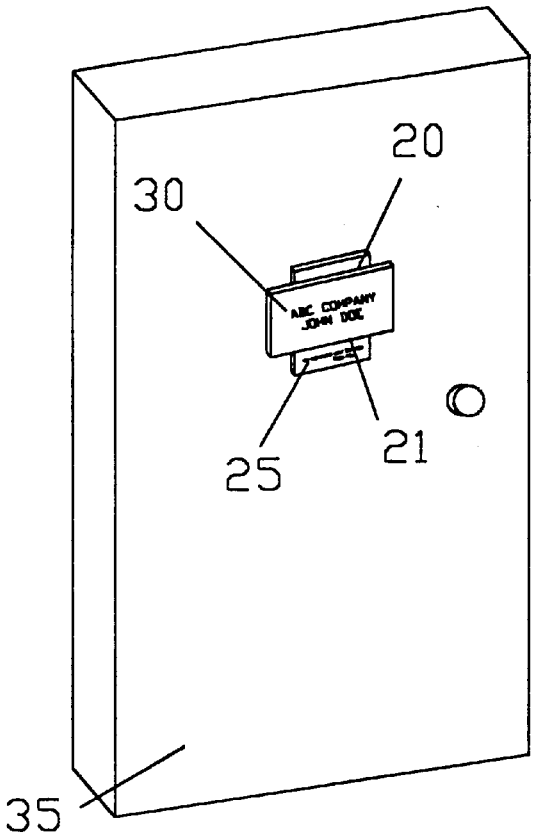
FIG. 4 is a perspective view of the repositionable securement strip with message and with a business card secured to the strip and with the strip secured to a door.
Figure 5:
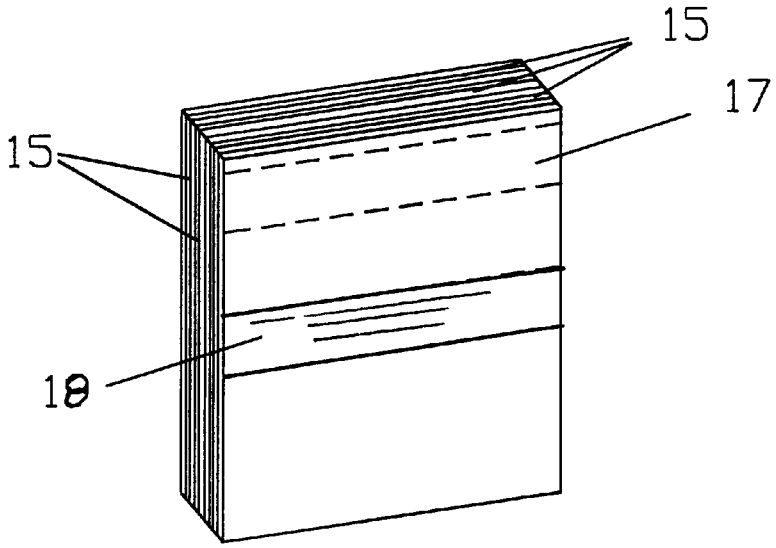
FIG. 5 is a perspective view of a plurality of repositionable securement strips in a detachably attached and stackable manner.

Referring to the drawings in FIGS. 1–4, in particular, the repositionable securement strip with message for business and announcement cards comprises a rectangular strip of paper 10 having a front side 15 and a back side 16 and being approximately two inches wide and three inches long but also capable of being adapted and sized according to the particular use and further having a first narrow band of repositionable adhesive 17 of approximately three quarters of an inch wide and extending transversely on the back side 16 of the strip near the top edge 20 thereof, the repositionable adhesive 17 being sufficient for removably adhering to an object such as a piece of stationary, a door 35, or a desk. The strip of paper 10 also includes a second narrow band of repositionable adhesive 18, as shown in FIG. 1, of approximately three quarters of an inch wide and extending transversely on the front side 15 of the strip generally intermediate of the top and bottom edges 20,21 of the strip, the repositionable adhesive 18 being sufficient for detachably retaining a card 30 such as a business or an announcement card with the back of the card 30 being attached upon the second narrow band of repositionable adhesive on the front side 15 of the strip which also includes a special message 25 from the provider of the card 30 to the receiver, the message 25 being printed on the front side 15 and generally near the bottom edge 21 of the strip and generally being in the form of a courtesy or information not provided in the card 30 stuck to the strip such as "We appreciate your Business. Thank You". Preferably, a plurality of such strips of paper 10 are stackably arranged and detachably attached to one another with the back side 16 of the immediate top strip of paper 10 being detachably attached to the front side 16 of the immediate bottom strip of paper 10 in essentially a packet.

For use, the user essentially peels or removes one of the repositionable securement strips off the packet and sticks it to a surface such as a door 35, wall, board, a sheet of stationary 36 or other advertisement material with the portion of the back side 16 of the strip coated with the first narrow band of repositionable adhesive 17 being removably secured to the object and with the front side 15 of the strip of paper 10 being exposed away from the object. Most of the strip of paper 10 is not stuck to the object which allows the user to easily and conveniently grasp the strip of paper 10 and remove it from the object. The user will use this strip of paper 10 with message 25 to secure and retain a card 30 such as a business card or an announcement card. The user will place the card 30 with its back side upon the front side 15 of the strip of paper 10, in particular, upon the second narrow band of repositionable adhesive 18 to removably secure the card 30 to the strip of paper 10 with the face of the card 30 being exposed away from the object. The card 30 should be positioned upon the strip of paper 10 so as not to cover or overlay the message 25 imprinted upon the front side 15 of the strip. Because of the adhesive being repositionable, the receiver can easily and conveniently remove the strip of paper 10 from the object without doing any damage to the object. This strip of paper 10 essentially guarantees that the receiver will receive or at least see the card 30. Without such a strip of paper 10, the user's only options are for the user to stick the card 30 in the door 35 hoping that the receiver will find it upon opening the door 35 or to place the card 30 loose in an envelope along with the sheet of stationary or advertisement also hoping that the receiver will get the card 30 upon opening the envelope. In addition, especially in business, a card 30 which is neatly and removably attached to a sheet of stationary or advertisement puts the user in a much better light than a person who simply places the card 30 loose in an envelope and is more professional than a card 30 which is essentially loose in an envelope.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A repositionable securement strip with message for business and courtesy cards comprising:

a strip of paper having a front side and a back side and further having a first narrow band of repositionable adhesive on said back side for removably attaching said strip of paper to an object including a door, a wall, and a sheet of stationary and also having a second narrow band of repositionable adhesive on said front side for removably securing a card for display upon the object, said strip of paper also having a special message im-printed upon said front side, said special message being either informational or courtesy and not being displayed upon the card.

2. A repositionable securement strip with message for business and courtesy cards as described in claim 1, wherein said first narrow band of repositionable adhesive is disposed transversely of said strip of paper near a top edge thereof, said first narrow band of repositionable adhesive being sufficient to removably secure a portion of said strip to the object.

3. A repositionable securement strip with message for business and courtesy cards as described in claim 2, wherein said second narrow band of repositionable adhesive is disposed transversely of said strip of paper intermediate of the top edge and a bottom edge thereof, said second narrow band of repositionable adhesive being sufficient to removably secure and retain a card for display.

4. A repositionable securement strip with message for business and courtesy cards as described in claim 3, wherein said special message is imprinted near the bottom edge of said strip of paper and is of a size which allows a person to easily and conveniently read it, said message also being disposed so that it can be read when a card is removably secured to said strip of paper.

5. A repositionable securement strip with message for business and courtesy cards as described in claim 3, wherein said strip of paper is approximately two inches wide and three inches long and can be adapted and sized according to its use.

6. A repositionable securement strip with message for business and courtesy cards as described in claim 3, wherein a plurality of repositionable securement strips are stackably arranged and detachably attached one to another in a packet.

7. A repositionable securement strip with message for business and courtesy cards as described in claim 6, wherein a back side of a top one of said repositionable securement strips are detachably attached to a front side of an immediate bottom one of said repositionable securement strips.

8. A method of removably securing a card to an object comprises the steps of:

providing a strip of paper having a front side and a back side and further having a first narrow band of repositionable adhesive on said back side for removably attaching said strip of paper to an object including a door, a wall, and a sheet of stationary and also having a second narrow band of repositionable adhesive on said front side for removably securing a card for display upon the object, said strip of paper also having a special message imprinted upon said front side, said special message being either informational or courtesy and not being displayed upon the card;

positioning said back side of said strip of paper against the object selected from the group consisting of a door, a wall, a board, a desk, a sheet of stationary, and advertisement material;

removably attaching said back side of said strip of paper at said first narrow band of repositionable adhesive to the object; and removably securing a card upon said second narrow band of repositionable adhesive on said strip of paper.

9. A method of removably securing a card to an object as described in claim 8, wherein the step of providing said strip of paper includes removing said strip of paper from a stack comprising a plurality of the same which are detachably attached to one another.

10. A method of removably securing a card to an object as described in claim 8, wherein the step of removably securing a card upon said second narrow band of repositionable adhesive includes removably securing a back side of the card to said front side of said strip of paper with a face of the card being exposed and displayed; and positioning the card neatly upon said strip of paper to not cover or overlay said message imprinted on said front side of said strip of paper.

11. A method of removably securing a card to an object as described in claim 10, wherein said card is a conventional sized business card.

12. A method of removably securing a card to an object as described in claim 10, wherein said card is an announcement card.

13. A method of removably securing a card to an object as described in claim 10, wherein said card is a greeting card.

14. A method of removably securing a card to an object as described in claim 10, wherein said card is a courtesy card.

* * * * *